US012728317B2

(12) United States Patent
Schmidt

(10) Patent No.: US 12,728,317 B2
(45) Date of Patent: Sep. 8, 2026

(54) PLAY APPARATUS FOR DEVELOPING BALANCE AND COORDINATION

(71) Applicant: Playground Equipment Services, L.L.C., Cincinnati, OH (US)

(72) Inventor: Eric L. Schmidt, Cincinnati, OH (US)

(73) Assignee: Playground Equipment Services, L.L.C., Cincinnati, OH (US)

( * ) Notice: Subject to any disclaimer, the term of this patent is extended or adjusted under 35 U.S.C. 154(b) by 0 days.

(21) Appl. No.: 19/198,301

(22) Filed: May 5, 2025

(65) Prior Publication Data

US 2025/0262485 A1 Aug. 21, 2025

Related U.S. Application Data

(63) Continuation of application No. 18/321,833, filed on May 23, 2023, now Pat. No. 12,311,232.

(60) Provisional application No. 63/483,872, filed on Feb. 8, 2023.

(51) Int. Cl.

| | |
|---|---|
| ***A63B 26/00*** | (2006.01) |
| ***A63B 9/00*** | (2006.01) |
| ***A63B 23/10*** | (2006.01) |
| ***E01C 13/00*** | (2006.01) |

(52) U.S. Cl.

CPC ..... *A63B 26/003* (2013.01); *A63B 9/00* (2013.01); *A63B 23/10* (2013.01); *E01C 13/00* (2013.01); *A63B 2009/006* (2013.01); *A63B 2208/12* (2013.01); *A63B 2209/00* (2013.01); *A63B 2244/087* (2013.01)

(58) Field of Classification Search

CPC ..... A63B 26/003; A63B 5/16; A63B 9/00; A63B 23/10; A63B 2009/006; A63B 2208/12; A63B 2209/00; A63B 2244/087; E01C 13/003

See application file for complete search history.

(56) References Cited

U.S. PATENT DOCUMENTS

| | | | | |
|---|---|---|---|---|
| 2005/0192125 | A1* | 9/2005 | Valliquette | A63B 63/00 473/446 |
| 2014/0275368 | A1* | 9/2014 | He | C08L 83/10 524/166 |
| 2017/0175349 | A1* | 6/2017 | Davis | B29B 17/0042 |

FOREIGN PATENT DOCUMENTS

| | | | | |
|---|---|---|---|---|
| KR | 101649288 B1 * | 8/2016 | | B44C 3/025 |
| KR | 102249756 B1 * | 5/2021 | | E01C 13/08 |

* cited by examiner

*Primary Examiner* — Andrew S Lo
(74) *Attorney, Agent, or Firm* — Jenei LLC

(57) ABSTRACT

A play structure for an indoor or outdoor playground is disclosed. The play structure comprises an inner molded unit made of poured-in-place (PIP) rubber subsurface. The PIP rubber subsurface is poured with a mixture of rubber buffing and urethane configured to deliver improved safety, playability, and reduced maintenance requirement. The play structure further comprises a synthetic outer layer adhered to an outer surface of the inner molded unit. The outer layer adheres to the outer surface of the inner molded unit using an adhesive layer. The play structure further comprises a flat bottom surface configured to mount over the playground system and a top surface with different angles. A set of play structures are shaped and arranged on the play surface to develop core strength, balance, and coordination in toddlers by walking, jumping, and climbing on them. Further, the play structure is provided in different design configurations.

15 Claims, 3 Drawing Sheets

PLAY APPARATUS FOR DEVELOPING BALANCE AND COORDINATION

FIELD CROSS-REFERENCE TO RELATED APPLICATIONS

The present Application is a continuation of U.S. patent application Ser. No. 18/321,833 entitled "PLAY APPARATUS FOR DEVELOPING BALANCE AND COORDINATION", filed May 23, 2023, which is a continuation-in-part of U.S. Patent Application Ser. No. 63/483,872 entitled "PLAY APPARATUS FOR DEVELOPING BALANCE AND COORDINATION", filed Feb. 8, 2023, which is hereby expressly incorporated by reference herein for all purposes.

FIELD OF THE INVENTION

The present invention generally relates to a play structure for use in a playground and methods of using such structures. More specifically, the present invention relates to a play structure provided in a playground configured to develop strength, balance, and coordination in toddlers.

BACKGROUND OF THE INVENTION

A playground is a place designed to provide an environment for children to facilitate various outdoor activities. Outdoor activities have always enthralled children, and recent parental attitudes towards physical fitness and exercise have contributed to increased attention to the need to provide children with recurring opportunities for routine moderate physical exertion. Modern playgrounds often have recreational equipment, many of which help children to develop physical coordination, strength, and flexibility, as well as providing recreation and enjoyment and supporting social and emotional development. Common in modern playgrounds is play structures that link many different pieces of equipment.

Children's playground structures are manufactured in all shapes, sizes, and colors. As any parent or teacher is aware, these play structures often have fun yet challenging features for children. It can be seen that playgrounds provide an ideal opportunity for children to master physical skills, such as learning to swing, balance, and climb. Personal development may be gained through the enhancement of skills, such as playing, communicating, and cooperating with other children and adults in the playground.

However, the installation of existing play structures is difficult due to structural complexity and cost is high in installation. Due to the materials and installation methods used to install playground equipment, it is difficult to change or expand a playground system after it has been installed.

The core set of body muscle groups is critical for the development of children, as well as those that have suffered development setbacks as a result of disease or injury. These core muscle groups provide the foundation of stability which is critical for the transfer of energy from large to small body parts. It also improves balance skills and posture control. The secondary muscle groups are the smaller body parts, which allow for fine and gross motor skills, particularly in the areas of body and item manipulation.

In light of the above-mentioned drawbacks, there is a need for a unique play structure that could be easily built into a synthetic rubber playground surface. Also, there is a need for a play structure for a playground to develop balance and coordination in children.

SUMMARY OF THE INVENTION

The present invention generally discloses a play structure for a playground system. More specifically, the present invention relates to a play structure provided in a playground configured to develop strength, balance, and coordination in toddlers.

According to the present invention, the play structure is an innovative and unique solution that has been designed to develop balance and coordination in toddlers. The play structure comprises an inner molded unit. In one embodiment, the inner molded unit is a cushion unit. In one embodiment, the inner molded unit is made from poured-in-place (PIP) rubber subsurface. In one embodiment, the PIP subsurface is poured with a mixture of rubber buffing and urethane. The rubber buffing may be Styrene Butadiene Rubber (SBR). In one embodiment, the PIP subsurface with the mixture of rubber buffing and urethane is configured to deliver improved safety, playability, and reduced maintenance requirement.

In one or more embodiments, the PIP rubber subsurface is a composite using ground rubber (buffings) and one or more binders. In one or more embodiments, the binders may include aliphatic urethane or any other suitable substances. Other suitable substances may include aromatic urethane. In one embodiment, the binder may be polyurethane binder or aromatic polyurethane binder. In one or more embodiments, the buffings component may generally be made up of elongated, i.e., fiber-like, predominantly styrene butadiene rubber (SBR) strands.

In one or more embodiments, the PIP rubber subsurface is formed from a rubber-containing mixture, which is poured onto a substrate. The rubber-containing mixture includes rubber particles and one or more binders that will bind the rubber. The rubber particles and binder(s) are placed into a mixer, which would likely be situated at or proximate to the prepared site at which the mat is to be formed. The rubber particles may be fine rubber crumbs, small rubber chunks, rubber slivers/buffing and combinations thereof. Further, the rubber particles may be recycled rubber particles, e.g., from used tires or other rubber products such as shredded recycled tires.

In one embodiment, the PIP rubber subsurface is formed from tire buffings and/or rubber chunks and may generally be made up of elongated, i.e. fiber-like, predominantly styrene butadiene rubber (SBR) strands. These strands are recycled tire rubber, typically obtained from the process of re-capping commercial truck tires. In some embodiments, the strands may have a thickness between about 0.5 mm and about 2.0 mm and a length between about 3.0 mm and about 20.0 mm. The strands may generally have an aspect ratio (length to width) of at least 2, alternatively at least 3, alternatively at least 5, alternatively at least 7. The binder may be any suitable polymeric binding material. In many embodiments, the binder may be polyurethane. The blending may be performed using conventional equipment, such as a rotating tumbler. In one embodiment, the binder may be provided in an amount of less than 10% by weight of the blend, alternatively less than 9% by weight of the blend, alternatively less than 8% by weight of the blend, alternatively less than 7% by weight of the blend, alternatively less than 6% by weight of the blend, alternatively less than 5% by weight of the blend. In one or more embodiments, the binder is polyurethane and comprises between 2% and 17% of the blend, between 3% and 12% of the blend, between 4% and 10% of the blend, between 5% and 9% of the blend, between 6% and 8% of the blend. In one or more embodiments, the binder is polyurethane and is present in the blend at about 7% by weight.

The poured blend may then be spread, e.g., through hand troweling, to produce an inner molded unit having a substantially consistent thickness and a smooth, even finish. As the binder dries and hardens, the cushion inner molded unit becomes set. The height of the inner molded unit may be selected to provide a desired degree of fall protection, i.e., impact absorption. In some embodiments, for example, the inner molded unit may be provided with a thickness between about 1 inch and about 24 inches, alternatively between about 1 inch and about 18 inches, alternatively between about 1 inch and about 12 inches, alternatively between about 2 inch and about 10 inches.

In some embodiments, the top surface of the play structure, e.g., the top surface of the outer (wear) layer, may be substantially planar with the adjacent ground surface. In some embodiments, the outer layer may have a thickness that is at least 0.25 inches, alternatively at least 0.4 inches, alternatively at least 0.5 inches. For example, the outer layer may have a thickness that is between 0.25 inches and 1.25 inch, alternatively between 0.4 inches and 1 inches, alternatively between 0.4 inches and 1 inches, alternatively between 0.5 inches and 1 inch, alternatively between 0.5 inches and 0.75 inches. The thickness of the outer layer may be selected to provide a desired degree of wear resistance (e.g., from shoes and mobility devices).

The inner molded layer of embodiments may comprise, consist essentially of, or consist of a blend of a rubber component and a binder. In some embodiments, the rubber component may comprise rubber chunk, tire buffings, or a combination thereof. In some embodiments, the rubber component may be at least 50% rubber chunk, alternatively at least 75% rubber chunk, alternatively 100% rubber chunk. In some embodiments, the rubber component may comprise styrene butadiene rubber, EPDM, nitrile/NBR, natural rubbers, or any combination thereof. The binder may be, for example, polyurethane. The binder may make up between 4% and 20% of the blend, alternatively between 5% and 15% of the blend, alternatively between 6% and 10% of the blend, for example.

In some embodiments, the inner molded unit is formed from poured-in-place (PIP) rubber subsurface and coated with the outer layer to form a completed play structure which can then be surface mounted or left portable. In some embodiments, the inner molded unit is formed from poured-in-place (PIP) rubber subsurface that is formed over a broad play surface (generally over top of a substrate) and coated with the outer layer that is formed either just over the inner unit or coated over the inner unit and the surrounding play surface to form a completed play surface with built-in play structures. In some embodiments, the inner molded unit can be formed, for example, by an in-situ created layer composed of an elastic granulate, a binder, and additional substances. Alternatively, the elastic layer can formed as molded units, e.g., made in a factory. In some embodiments, the inner molded unit and the outer layer can be fabricated "in situ"; e.g., by mixing together the components of a liquid reaction mixture to be used as the binder (the mixture may optionally comprise elastic granules and/or non-elastic fibers) at the use site a short time (within one hour or less) before the liquid mixture is applied onto a substrate or base. "Substrate" as used herein, refers to any surface upon which it is desirable to deposit a synthetic PIP surfacing system. In the present invention, the substrate is generally made up of fine granules of stone, gravel, sand, asphalt, cement, ceramic beads, soil, clay, diatomaceous earth, perlite, silica, organic minerals, rubber or combinations thereof.

In some embodiments, the play surfacing or "poured-in-place" surfacing is installed on site and requires groundwork prior to installation to ensure that base surface is suitable. Typically, a stone, concrete or tarmac layer is put down followed by one or more layers of wet-pour surface. The wet pour surfacing material is often made up of two rubber layers; a first layer of a rubber such as SBR (styrene butadiene rubber) granules, which are often recycled truck tire material. A binder may be used in the SBR layer. An upper layer of rubber e.g., TPV (dynamically vulcanized thermoplastic), TPE (thermoplastic elastomer) and/or EPDM (ethylene propylene diene modified) rubber granules mixed with a binder e.g., a polyurethane binder or resin is then installed on top of the SBR layer.

The finished play surface can be multi-layered with one or more play structures integrally formed in the surface. The play structures can be formed having size and placement to allow for proper usage. The integrally formed play structures in the play surfacing can include 1, 2, 3, 4, or more play structures, which may be formed in random or patterned fashion. In other embodiments, the integral formed play structures can form two or more series of play structures within in the play surfacing. The finished play surface may provide for a poured-in-place ADA-compliant safety surface. In one or more embodiments, the shock absorption rates of the play structures is about 5-20%. In another embodiments, the shock absorption rates of the play structures is about 10-20%. In another embodiments, the shock absorption rates of the play structures is at least 2, 3, 4, 5, 6, 7, 8, 9, 10, 11, 12, 15% or more.

In some embodiments, the outer layer may comprise, consist essentially of, or consist of a blend of rubber granules and a binder. The rubber granules may be significantly smaller than the rubber component of the cushion layer. In some embodiments, the rubber granules may be sized between 1 and 4 mm, alternatively between 1 and 3.5 mm. The rubber granules may comprise or consist of thermoplastic vulcanizates (TPV) granules. The binder may be, for example, polyurethane. The binder may make up between 15% and 25% of the wear layer blend, alternatively between 16% and 24%, alternatively between 17% and 23% of the wear layer blend, alternatively between 17% and 22% of the wear layer blend, for example.

In one embodiment, the PIP rubber subsurface buffings have a dimension of about 0.187" (for 4 mesh), 0.0787" (for 10 mesh), 0.473" (for 16 mesh), or mixtures thereof. The 4 mesh has the ability to retain about 0-10% particles. The 10 mesh has the ability to retain about 10-30% particles. The 16 mesh has the ability to retain about 40-60% particles. The pan has the ability to retain about 0-5% particles. U.S. mesh size (or U.S. sieve size) is defined as the number of openings in one square inch of a screen. For example, a 36-mesh screen will have 36 openings while a 150-mesh screen will have 150 openings. Since the size of screen (one square inch) is constant, the higher the mesh number the smaller the screen opening and the smaller the particle that will pass through. Generally US mesh is measured using screens down to a 325-mesh (325 openings in one square inch). In one embodiment, the PIP rubber subsurface buffings are sized larger than 10, 8, 6, 4 mesh or larger. In another embodiment, the PIP rubber subsurface buffings are sized smaller than about 2", 1.5", 1" or less. In another embodiment, the PIP rubber subsurface buffings are sized from about 2" pieces to 30 mesh dust sized particles. In another embodiment, the PIP rubber subsurface buffings are sized from about 1 mm to 55 mm. In another embodiment, the PIP rubber subsurface buffings are sized from about 1 mm to 42 mm. In another embodiment, the PIP rubber subsurface buffings are sized from about 1 mm to 32 mm. In another embodiment, the PIP rubber subsurface buffings are sized about 2-14 mesh. In another embodiment, the PIP rubber subsurface buffings are sized about 4-10 mesh.

In one embodiment, the PIP rubber subsurface is the key component for delivering performance, playability, and safety while greatly decreasing the amount of maintenance required. In one embodiment, the material itself provides buoyancy and the voids in the subsurface range between 0.1 and 0.4 inches.

In one embodiment, the PIP rubber subsurface is treated with polyurethane. In one embodiment, the PIP rubber subsurface is poured with a mixture of rubber buffing and urethane configured to deliver improved safety, playability, and reduced maintenance requirements. In one embodiment, the mixture utilizes 8 to 32 pounds of urethane per 100 pounds of rubber buffing. In one or more embodiments, the mixture utilizes 1:10 to 1:4 binder (such as polyurethane) to rubber ratio. In one or more embodiments, the mixture utilizes a 1:10, 1:9, 1:8, 1:7, 1:6, 1:5, or 1:4 binder (such as polyurethane) to rubber ratio. In one or more embodiments, the binder (such as polyurethane) constitutes 5 wt. % to 30 wt. % of the final subsurface. In one or more embodiments, the binder (such as polyurethane) comprises at least 5, 6, 7, 8, 9, 10, 11, 12, 13, 14, 15 wt. % or more of the final subsurface. In another embodiment, the binder (such as polyurethane) comprises at most 30, 25, 20, 19, 18, 17, 16, 15, 14, 13, 12, 11, 10 wt. % or less of the final subsurface.

The play structure further comprises an outer layer. In one embodiment, the outer layer is a harder wear layer. In one embodiment, the outer layer is made of Ethylene Propylene Diene Monomer (EDPM) rubber. In one embodiment, the outer wear layer comprises a high-grade EPDM rubber granule mixture with a polymer resin binder in a depth of from about 4 to about 40 mm. In another embodiment, the outer wear layer comprises a high-grade EPDM rubber granule mixture with a polymer resin binder in a depth of from about 5 to about 25 mm. In one embodiment, the outer layer adheres to an outer surface of the inner molded unit. In one embodiment, the outer layer adheres to the outer surface of the inner molded unit using an adhesive layer. In one embodiment, the outer layer is secured to the PIP rubber subsurface using the adhesive layer. In one embodiment, the adhesive layer may include, but not limited to, a glue, binder, resin, or any other suitable adhesive material. In general, Anthropometric measurements are used to determine a human being's nutritional and general health status. In one embodiment, the material is made to ASTM 1487 fall specifications. In one embodiment, the material prepared in accordance with the present disclosure was tested for head impact criteria (HIC) properties, as tested by the test procedure designated by IPEMA (International Play Equipment Manufacturers Association) as Impact Attenuation Test ASTM F1292-18, at various thicknesses, and found to provide desirable results.

In some embodiments, the outer layer may be a poured-in-place material that can be installed by pouring and spreading in much the same manner as the inner molded layer. For instance, the outer layer may be a blend of one or more rubber materials and a binder. In some embodiments, for example, the outer layer may comprise EPDM, TPV, or another treated rubber blended with a polyurethane binder. The rubber granules used in the outer layer may generally have a greater degree of uniformity than those used in the inner molded unit. For example, in some embodiments, the rubber granules used in the outer layer may have cross-sections between about 1 mm and about 4 mm or between about 0.5 mm and about 1.5 mm. The outer layer may also be prepared in any number of desirable colors, such as through the provision of pre-colored granules and the (typically on-site) mixing of those pre-colored granules in a desired ratio. The outer layer may have any desired thickness. In many embodiments, the outer layer may have a thickness of less than 1.5 inches, alternatively less than 1 inch, alternatively less than ¾-inch.

In some embodiments, the outer layer is a wear layer and may have a thickness that is at least 0.25 inches, alternatively at least 0.4 inches, alternatively at least 0.5 inches. For example, the wear layer may have a thickness that is between 0.4 inches and 1 inch, alternatively between 0.4 inches and 0.75 inches, alternatively between 0.4 inches and 0.5 inches, alternatively between 0.5 inches and 1 inch, alternatively between 0.5 inches and 0.75 inches. The thickness of the wear layer may be selected to provide a desired degree of wear resistance (e.g., from shoes and mobility devices).

In some embodiments, the play structure may be configured to provide a degree of impact attenuation performance characterized by a Head Injury Criterion or HIC score. The Head Injury Criterion or HIC score is an empirical measure of impact severity based on published research describing the relationship between the magnitude and duration of impact accelerations and the risk of head trauma. In particular, ASTM F1292-18 provides a means of determining impact attenuation performance using a test method that simulates the impact of a person's head with the surface. The same impact attenuation performance testing can also advantageously be used in the context of the play structures of the present disclosure.

The adhesive layer can include polyurethane, latex, hot melt adhesive, and/or thermoplastics alone or in combination. Suitable hot melt adhesives include, but are not limited to, Reynolds 54-041, Reynolds 54-854, DHM 4124 (The Reynolds Company P.O. Greenville, S.C., DHM Adhesives, Inc. Calhoun, Ga.). Suitable thermoplastics include, but are not limited to polypropylene, polyethylene and polyester. The adhesive layer can also include a filler such as coal fly ash, calcium carbonate, iron oxide, or barium sulfate, or any other filler known in the art. The adhesive layer can include from about 0 wt. % to about 100 wt. % polyurethane, from about 0 wt. % to about 100 wt. % latex, from about 0 wt. % to about 100 wt. % hot melt adhesives, and/or from about 0 wt. % to about 100 wt. % thermoplastic.

In one embodiment, the play structure further comprises a flat bottom surface configured to properly mount the play structure on the playground surface. In one embodiment, the bottom surface has a dimension of about 18" in diameter. The diameter of the play structure may include, but not limited to, 4", 6", 8", 10", 12", 14" etc. In one embodiment, the play structure has a diameter of from about 4" to about 24". In another embodiment, the play structure has a diameter of from about 6" to about 20". In one embodiment, the play structure has varying heights. The height of the play structure may include, but not limited to, 4", 6", 8", 10", 12", 14" etc.

In one embodiment, the play structure further comprises a top surface configured to allow the toddlers to walk, jump, or climb on them, thereby developing core strength, balance, and coordination in toddlers (usually under age 5 years). In one embodiment, the top surface has a dimension of about 10" in diameter. The diameter of the top surface may include, but not limited to, 4", 6", 8", 10", 12", 14" etc. In one embodiment, the top surface has a diameter of from about 4" to about 20". In another embodiment, the top surface has a diameter of from about 6" to about 18". In one embodiment, the top surface is provided with different angles. In one embodiment, the different angles of the top surface assist the toddlers to bend their foot to up and/or down to build those muscles.

In one embodiment, the play structure is built into the synthetic rubber playground surface. The play structure is provided in different design configuration. In one embodiment, the play structure comprises a gumdrop-shaped configuration. In another embodiment, the play structure comprises a rock-shaped configuration. A series of play structures are set at about 18" on center. That is, the base is sized so that when touching, they are the correct distance apart. Further, the play structures may be provided in different colors and shapes that are built on the synthetic playground surface.

This invention relates to play structures used for therapeutic purposes in the realm of occupational or physical therapy. The present invention is a play structure, which allows a child, either with or without the aid of a health-care professional or assistant, to strengthen the core and secondary body muscle groups. The play structures may be affixed or portable. The present invention provides a and convenient means to address the needs of developing core and secondary muscle groups. A user may flex their feet forward and back to stimulate their muscles and feet differently and to improve their balance. Alternatively, a user may rock forward and backward or rock side-to-side to improve their balance and stretch their calves.

A user is defined as any sized person able to stand on the disclosed devices or to perform exercises upon one of them, and to achieve a rebound response. A user may bend or flex or otherwise move on one of the disclosed play structures on their feet or other body part, or move and manipulate such a device to some degree with their feet or other body part to reposition it. While designed for toddlers, the disclosed devices are usable by any person of any size.

The above summary contains simplifications, generalizations, and omissions of detail and is not intended as a comprehensive description of the claimed subject matter but, rather, is intended to provide a brief overview of some of the functionality associated therewith. Other systems, methods, functionality, features, and advantages of the claimed subject matter will be or will become apparent to one with skill in the art upon examination of the following figures and detailed written description.

BRIEF DESCRIPTION OF DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION OF THE INVENTION

Figure 1:
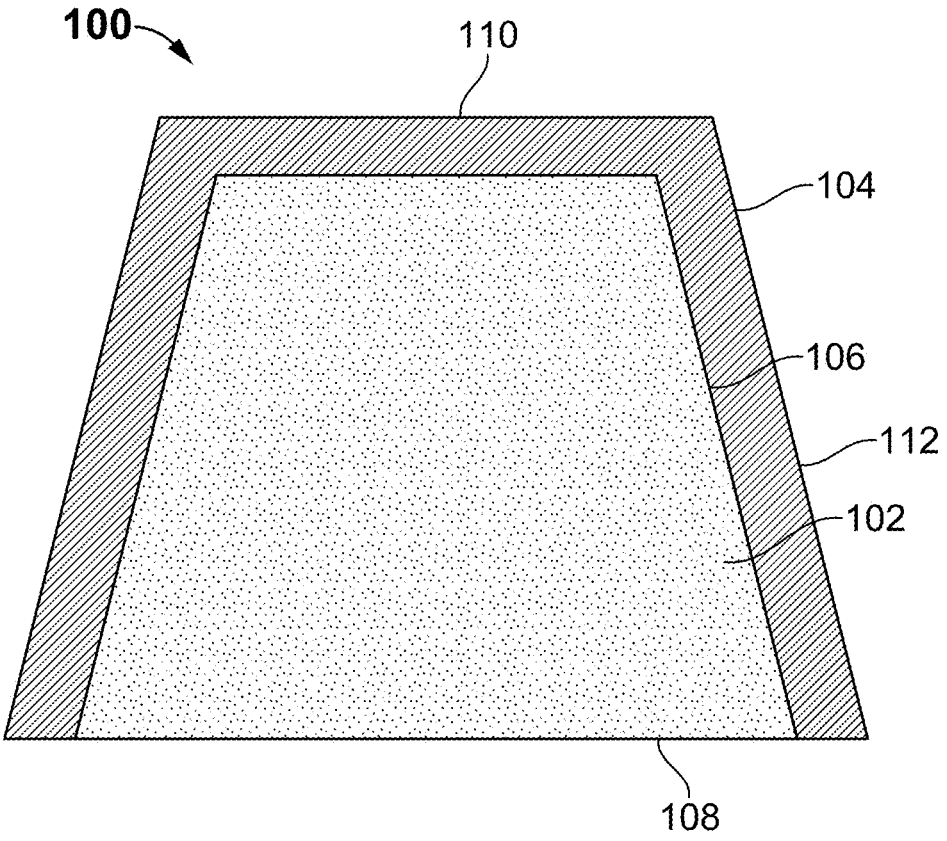
FIG. 1 shows a play structure for a playground system in an embodiment of the present invention.

Before describing the present invention in detail, it is to be understood that this invention is not limited to particularly exemplified systems or process parameters as such may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent, or patent application was specifically and individually indicated as incorporated by reference.

It must be noted that, as used in this specification and the appended claims, the singular forms "a," "an" and "the" include plural referents unless the content clearly dictates otherwise. Thus, for example, reference to a "colorant agent" includes two or more such agents.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

As will be appreciated by one having ordinary skill in the art, the methods and compositions of the invention substantially reduce or eliminate the disadvantages and drawbacks associated with prior art methods and compositions.

It should be noted that, when employed in the present disclosure, the terms "comprises," "comprising," and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

Definitions

As used in the present specification, the following words and phrases are generally intended to have the meanings as set forth below, except to the extent that the context in which they are used indicates otherwise.

"Binders" as used herein, refers to be any binder known to those skilled in the art which interacts with rubber particles and binds the rubber particles into a cohesive unit, e.g., when the binder is exposed to air for a certain amount of time. Binder or binding agent refers to a material having binding, adhesive, or attachment properties with or without chemical, thermal, pressure or other treatment. An example of a common binder used in this field is polyurethane. Polyurethanes are generally produced by mixing two or more liquid streams (or "liquid components"), a polyol stream (also referred to as 'B component') and the isocyanate stream (also referred herein as 'A component'). According to embodiments, the polyol stream contains catalysts, surfactants, blowing agents and so on. This mixture might also be called a 'resin' or 'resin blend' or 'reaction mixture'.

The reaction mixture may further comprise chain extenders, cross-linkers, surfactants, flame retardants, pigments, and fillers.

Two other types of common binders are SBR and acrylic binders. SBR binders are often used to increase sealing performance with oils. SBR binders generally will cause a material to swell or expand when in contact with oils. This property provides increased sealing performance by allowing the material to seal potential leak paths in an application. SBR materials offer better sealing performance with less-than-ideal sealing flange surfaces, or between dissimilar sealing surfaces, such as a stamped-pan sealing against a cast surface area. H&V material grade names that begin with the letter "S" use an SBR binder system. Acrylic binders are similar to those used in paints. The polymeric binder used in the present invention can be selected from the group comprising polyurethane, polyester, polyether, polyacrylate, polystyrene, polyvinyl chloride, polyvinyl acetate, acrylic polyesters, polyethylene, polyepoxide, silicones, of synthetic origin, natural or combinations thereof. Preferably, the polymeric binder is polyurethane. Preferably still, the polymeric binder is in liquid form.

In the present invention, "cure" or "curing" refers to the hardening of the polymeric material through a crosslinking method.

"Polymer" as used herein, refers to a series of repeating monomeric units that have been cross-linked or polymerized. Any suitable polymer can be used to carry out the present invention. It is possible that the polymers of the invention may also comprise two, three, four or more different polymers. In some embodiments, of the invention only one polymer is used. In some preferred embodiments a combination of two polymers is used. Combinations of polymers can be in varying ratios, to provide polymer coatings with differing properties. Those of skill in the art of polymer chemistry will be familiar with the different properties of polymeric compounds. Examples of polymers that may be used in the present invention include, but are not limited to polycarboxylic acids, cellulosic polymers, proteins, polypeptides, polyvinylpyrrolidone, maleic anhydride polymers, polyamides, polyvinyl alcohols, polyethylene oxides, glycosaminoglycans, polysaccharides, polyesters, polyurethanes, polystyrenes, copolymers, silicones, polyorthoesters, polyanhydrides, copolymers of vinyl monomers, polycarbonates, polyethylenes, polypropylenes, polylactic acids, polyglycolic acids, polycaprolactones, polyhydroxybutyrate valerates, polyacrylamides, polyethers, polyurethane dispersions, polyacrylates, acrylic latex dispersions, polyacrylic acid, mixtures and copolymers thereof. The polymers of the present invention may be natural or synthetic in origin, including gelatin, chitosan, dextrin, cyclodextrin, poly(urethanes), Poly(siloxanes) or silicones, Poly(acrylates) such as poly(methyl methacrylate), poly(butyl methacrylate), and Poly(2-hydroxy ethyl methacrylate), Poly(vinyl alcohol) Poly(olefins) such as poly(ethylene), poly(isoprene), halogenated polymers such as Poly(tetrafluoroethylene)—and derivatives and copolymers such as those commonly sold as Teflon products, Poly(vinylidine fluoride), Poly(vinyl acetate), Poly(vinyl pyrrolidone), Poly(acrylic acid), Polyacrylamide, Poly(ethylene-co-vinyl acetate), Poly(ethylene glycol), Poly(propylene glycol), Poly(methacrylic acid); etc.

"Playground" describes an area either indoors or outdoors where people; especially but not solely children play; optionally using playground apparatus such as slides and swings. The term also covers areas where walking, games or physical exercises are carried out. A "play surface" as used herein is any type of floor or flooring that is used as a floor or ground in a playground or play area. By "surface area", within the context of the present invention, is understood to mean any measure of area in which it is intended to build a play surface.

The term "rubber" as used in relation to either rubber particles or rubber coated particles means any resilient elastomeric material, including natural and artificial rubbers, elastomers, and polymers such as thermoplastic polymers and elastomers and equivalent materials. Examples of elastomers include acryl rubber, butyl rubber, carboxylated acrylonitrile butadiene rubber (XNBR), carboxylated hydrogenated acrylonitrile butadiene rubber (XHNBR), EPDM/acrylonitrile graft copolymer, EPDM/styrene copolymer, epoxylated natural rubber, ethylene propylene (EPR), ethylene-propylene copolymers, ethylene-propylene-diene monomer (EPDM) rubber, ethylene-propylene-diene terpolymers, ethylenically unsaturated nitrile-conjugated diene-based high saturation copolymer rubber, fluoroelastomers (FKM), halogenated butyl rubber, hereinafter called EPDM, hereinafter called EPM, hydrin rubber, hydrogenated acrylonitrile butadiene rubber (HNBR), hydrogenated carboxylated acrylonitrile butadiene rubber (HXNBR), maleated BIMS copolymer, maleated ethylene-acrylic acid copolymer, maleated ethylene-butene rubber, maleated ethylene-decene rubber, maleated ethylene-ethyl acrylate copolymer, maleated ethylene-hexene rubber, maleated ethylene-methyl acrylate copolymer, maleated ethylene-octene rubber, maleated ethylene-propylene copolymer rubber, maleated ethylene-vinyl acetate copolymer, maleated halogenated isobutylene-isoprene copolymer, maleated isobutylene-isoprene copolymer, maleated isobutylene-paramethylstyrene copolymer, maleated star branched butyl (SBB) copolymer, maleic acid modified EPDM/acrylonitrile graft copolymer, maleic acid modified EPDM/styrene copolymer, maleic anhydride grafted acrylonitrile-butadiene-styrene rubber, maleic anhydride grafted ethylene-propylene-diene rubber, maleic anhydride grafted styrene-ethylene/butadiene-styrene rubber, natural rubbers, nitrile acrylonitrile butadiene rubber (NBR), nitrile butadiene rubber, nitrile rubber, perfluoroelastomers (FEKM), polyetheresters, polyethylene or polypropylene homo- or copolymers and polyisobutylene, polyisoprene, polymers comprising a thermoplastic and an elastomer, polyurethanes, reactive phenoxy thermoplastic resins, styrene-butadiene rubber (SBR), styrene/maleic acid copolymer, tetrafluoroethylene and propylene monomer (FEPM) elastomers as well as copolymers and mixtures thereof.

These terms may be defined with additional language in the remaining portions of the specification.

A description of embodiments of the present invention will now be given with reference to the Figures. It is expected that the present invention may be embodied in other specific forms without departing from its spirit or essential characteristics. The described embodiments are to be considered in all respects only as illustrative and not restrictive.

Referring to FIG. 1, a synthetic play structure (hereinafter referred as play structure) 100 is illustrated. The play structure 100 is an innovative and unique solution that has been designed to develop balance and coordination in toddlers. The play structure 100 comprises an inner molded unit 102. In one embodiment, the inner molded unit 102 is a cushion unit. In one embodiment, the inner molded unit 102 is made from poured-in-place (PIP) rubber subsurface. In one embodiment, the PIP subsurface is poured with a mixture of rubber buffing and urethane. The rubber buffing may be Styrene Butadiene Rubber (SBR). In one embodiment, the PIP subsurface with the mixture of rubber buffing and urethane is configured to deliver improved safety, playability, and reduced maintenance requirement.

The play structure 100 further comprises an outer layer 104. In one embodiment, the outer layer 104 is a harder wear layer. In one embodiment, the outer layer 104 is made of Ethylene Propylene Diene Monomer (EDPM) rubber. In one embodiment, the outer layer 104 adheres to an outer surface of the inner molded unit 102. In one embodiment, the outer layer 104 is adhered to the outer surface of the inner molded unit 102 using an adhesive layer 106. In one embodiment, the outer layer 104 is secured to the PIP rubber subsurface using the adhesive layer 106. In one embodiment, the adhesive layer may include, but not limited to, a glue, binder, resin, or any other suitable adhesive material. In general, Anthropometric measurements are used to determine a human being's nutritional and general health status. Here, the material is made to ASTM 1487 fall specifications.

The adhesive layer 106 can include polyurethane, latex, hot melt adhesive, and/or thermoplastics alone or in combination. Suitable hot melt adhesives include, but are not limited to, Reynolds 54-041, Reynolds 54-854, DHM 4124 (The Reynolds Company P.O. Greenville, S.C., DHM Adhesives, Inc. Calhoun, Ga.). Suitable thermoplastics include, but are not limited to polypropylene, polyethylene and polyester. The adhesive layer 106 can also include a filler such as coal fly ash, calcium carbonate, iron oxide, or barium sulfate, or any other filler known in the art. The adhesive layer 106 can include from about 0 wt. % to about 100 wt. % polyurethane, from about 0 wt. % to about 100 wt. % latex, from about 0 wt. % to about 100 wt. % hot melt adhesives, and/or from about 0 wt. % to about 100 wt. % thermoplastic.

In one embodiment, the play structure 100 further comprises a flat bottom surface 108 configured to properly mount the play structure on the playground surface 130. In one embodiment, the bottom surface 108 has a dimension of about 18" in diameter. In one embodiment, the play structure 100 has varying heights. The height of the play structure 100 may include, but not limited to, 4", 6", 8", 10", etc.

In one embodiment, the play structure 100 further comprises a top surface 110 configured to allow the toddlers to walk, jump, or climb on them, thereby developing core strength, balance, and coordination in toddlers (usually under age 5 years). In one embodiment, the top surface 110 has a dimension of about 10" in diameter. In one embodiment, the top surface 110 is provided with different angles. In one embodiment, the different angles of the top surface 110 assist the toddlers to bend their foot to up and/or down to build those muscles.

In some embodiments, the play structure 100 further comprises a side edge 112, which is angled less than 70°, alternatively less than 65°, alternatively less than 60° with respect to an adjacent ground surface. In some embodiments, the play structures have a side edge 112, which is angled greater than 5°, alternatively greater than 10°, alternatively greater than 20°, alternatively greater than 30° with respect to the adjacent ground surface. In some embodiments, for example, the side edge 112 may be angled between 70° and 10°, alternatively between 65° and 20°, alternatively between 60° and 30° with respect to an adjacent ground surface.

Poured-in-Place (PIP) Rubber Subsurface

In one or more embodiments, the PIP rubber subsurface is a composite using ground rubber (buffings) and one or more binders. In one embodiment, the binder may be polyurethane binder or aromatic polyurethane binder. In one or more embodiments, the buffings component may generally be made up of elongated, i.e., fiber-like, predominantly styrene butadiene rubber (SBR) strands.

In one or more embodiments, the PIP rubber subsurface is formed from a rubber-containing mixture, which is poured onto a substrate. The rubber-containing mixture includes rubber particles and one or more binders that will bind the rubber. The rubber particles and binder(s) are placed into a mixer, which would likely be situated at or proximate to the prepared site at which the mat is to be formed. The rubber particles may be fine rubber crumbs, small rubber chunks, rubber slivers/buffing and combinations thereof. Further, the rubber particles may be recycled rubber particles, e.g., from used tires or other rubber products such as shredded recycled tires.

The binders may each be any binder known to those skilled in the art which interacts with rubber particles and binds the rubber particles into a cohesive unit, e.g., when the binder is exposed to air for a certain amount of time. An example of a common binder used in this field is polyurethane. Two other types of common binders are SBR and acrylic binders. SBR binders are often used to increase sealing performance with oils. SBR binders generally will cause a material to swell or expand when in contact with oils. This property provides increased sealing performance by allowing the material to seal potential leak paths in an application. In one embodiment, the binder may be polyurethane binder or aromatic polyurethane binder. The polyurethane binder has various properties at specific test conditions.

In one embodiment, the PIP rubber subsurface is treated with polyurethane. In one embodiment, the PIP rubber subsurface is poured with a mixture of rubber buffing and urethane configured to deliver improved safety, playability, and reduced maintenance requirements for the play structure 100 that is placed on a playing surface 130 (shown in FIGS. 2 and 3). In one embodiment, the mixture utilizes 8 to 32 pounds of urethane per 100 pounds of rubber buffing. In one embodiment, the PIP rubber subsurface is formed from a rubber-containing mixture of rubber buffings and rubber granules (crumb rubber), in particular ethylene propylene diene monomer (EPDM) rubber granules or styrene-butadiene rubber (SBR) granules.

In one embodiment, the PIP rubber subsurface is treated with polyurethane. In one embodiment, the PIP rubber subsurface is poured with a mixture of rubber buffing and urethane configured to deliver improved safety, playability, and reduced maintenance requirements for the synthetic turf that is placed on a playing surface. In one embodiment, the mixture utilizes 8 to 32 pounds of urethane per 100 pounds of rubber buffing. In one or more embodiments, the mixture utilizes 1:10 to 1:4 binder (such as polyurethane) to rubber ratio. In one or more embodiments, the mixture utilizes a 1:10, 1:9, 1:8, 1:7, 1:6, 1:5, or 1:4 binder (such as polyurethane) to rubber ratio. In one or more embodiments, the binder (such as polyurethane) constitutes 5 wt. % to 30 wt. % of the final subsurface. In one or more embodiments, the binder (such as polyurethane) comprises at least 5, 6, 7, 8, 9, 10, 11, 12, 13, 14, 15 wt. % or more of the final subsurface. In another embodiment, the binder (such as polyurethane) comprises at most 30, 25, 20, 19, 18, 17, 16, 15, 14, 13, 12, 11, 10 wt. % or less of the final subsurface.

In one embodiment, the PIP rubber subsurface is formed from a rubber-containing mixture of 10:90, 20:80, 30:70; 40:60: 50:50, 60:40, 70:30, 80:20, 90:10 rubber buffings to rubber granules ratio. In one embodiment, the PIP rubber subsurface is poured with a mixture of rubber buffing and urethane configured to deliver improved safety, playability, and reduced maintenance requirements for the play structure 100 placed on the playing surface 130. The PIP rubber subsurface is poured or troweled on the ground structure or site. In one embodiment, the play structure 100 further maintains consistent concussion resistance throughout the entire playing surface.

In one embodiment, the PIP rubber subsurface comprises rubber buffings with a dimension of about 0.187" (for 4 mesh), 0.0787" (for 10 mesh), and 0.473" (for 16 mesh). In another embodiment, the PIP rubber subsurface comprises rubber buffings with a dimension of about 2-20 mesh or 4-16 mesh. In one embodiment, the thickness of the PIP rubber subsurface is customized to meet GMAX and fall height requirements. In one embodiment, the PIP rubber subsurface is the key component for delivering performance, playability, and safety for the athletes while greatly decreasing the amount of maintenance required.

Figure 2:
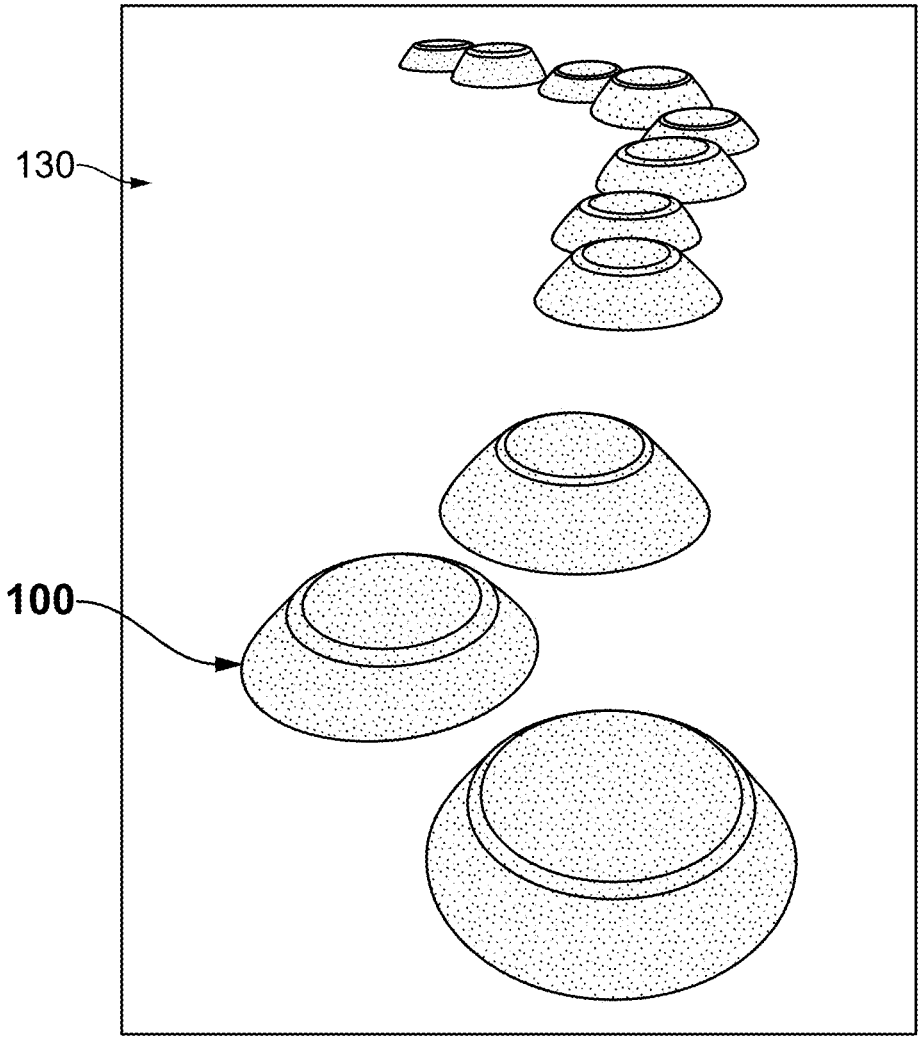
FIG. 2 shows the play structure installed on the playground surface in one embodiment of the present invention.
Figure 3:
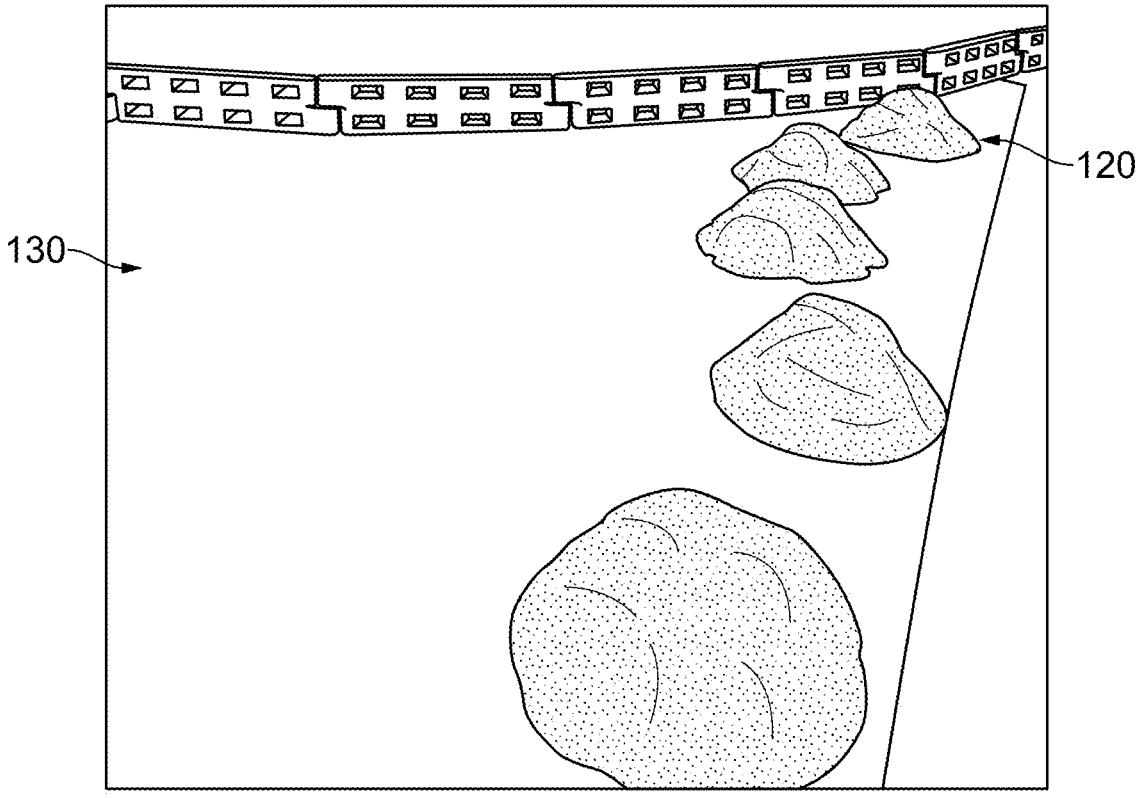
FIG. 3 shows a play structure installed on the playground surface in another embodiment of the present invention.

Referring to FIGS. 2-3, the play structure 100 installed on a playground system 130 according to different embodiments are illustrated. In one embodiment, the play structure 100 can be built into a synthetic rubber playground surface 130. The play structure 100 comprises an inner molded unit 102 and an outer layer 104. In one embodiment, the inner molded unit 102 is made of a poured-in-place (PIP) rubber subsurface. The outer layer 104 is adhered to the inner molded unit 102. The outer layer 104 is secured to the PIP rubber subsurface. In one embodiment, the outer layer 104 is secured to the PIP rubber subsurface using an adhesive layer 106. The adhesive layer 106 may be, but not limited to, a glue, binder, resin, or other suitable adhesive material.

In one embodiment, the play structure 100 further comprises a flat bottom surface 108 and a top surface 110. The play structure 100 is built into the synthetic rubber playground surface 130. The play structure 100 is provided in different design configuration. In one embodiment, the play structure 100 comprises a gumdrop-shaped configuration (as shown in FIG. 2). In another embodiment, the play structure 100 comprises a rock-shaped configuration 120 (as shown in FIG. 3). A series of play structures 100 are set at about 18" on center. That is, the base is sized so that when touching, they are the correct distance apart. Further, the play structures 100 may be provided in different colors and shapes that are built on the synthetic playground surface 130 (as shown in FIGS. 2 and 3).

In one embodiment, the PIP rubber subsurface is treated with polyurethane. In one embodiment, the PIP rubber subsurface is poured with a mixture of rubber buffing and urethane configured to deliver improved safety, playability, and reduced maintenance requirements for the play structure 100 that is placed on the playing surface 130. In one embodiment, the mixture utilizes 8 to 32 pounds of urethane per 100 pounds of rubber buffing.

In another embodiment, a color altering agent such as a dye, pigmented polymer, metallic paint, bleach, lightener, etc. may be added to vary the color of absorbent particles, such as to darken or lighten the color of all or parts of the composition so it is more appealing. In another embodiment, the color-altering agent comprises up to approximately 20% of the absorbent composition, more preferably, 0.001%-5% of the composition. In another embodiment, the color altering agent comprises approximately 0.01%-1% of the composition. In another embodiment, the carriers for the color-altering agent are zeolites, carbon, charcoal, etc. These substrates can be dyed, painted, coated with powdered colorant, etc.

Preparation of the site for a play surface may include defining an area in which the surfacing is to be formed and then placing substrate or loose fill material into the defined area. To define the area, the underlying ground surface may be worked as known to those skilled in the art. Alternatively, the ground surface does not have to be worked and may be left as is, e.g., ungraded, because the loose fill material will naturally fill in any voids or depressions in the ground surface.

The rubber particles may be fine rubber crumbs, small rubber chunks, rubber slivers/buffing and combinations thereof. Further, the rubber particles may be recycled rubber particles, e.g., from used tires or other rubber products such as shredded recycled tires.

Rubber particles include granular material, which may be fabricated of a rubber material. In another embodiment, the granular material comprises SBR crumb rubber. In one embodiment, crumb rubber particles have a median size that is within a range of about 10 to about 80 mesh.

In one embodiment, the rubber particles are made from styrene-butadiene or styrene-butadiene rubber (SBR) families of synthetic rubbers derived from styrene and butadiene. These materials have good abrasion resistance and good aging stability when protected by additives. In one embodiment, the rubber particles are black recycled rubber in particle sizes of 0.5 mm-4 mm.

In another embodiment, the rubber particles are made from EPDM rubber (ethylene propylene diene monomer (M-class) rubber), a type of synthetic rubber. EPDM rubber is primarily used because of its resistance to extremes of temperature and its general toughness.

In another embodiment, the rubber particles are made from TPV (Thermoplastic Vulcanizate) rubber granules for same applications, such as EPDM rubber granules. TPV granules are highly color stable, elastic, long lasting materials that can be used in athletic track facilities. EPDM and TPV granules with sizes 0.5-1.5 mm can be used for spray coating applications for running tracks and our 0.5-5 mm granules are used for multipurpose sport floors and playground floors.

In one embodiment, a primer, which is used as an adhesive component between the sub-floor and the successive layers of surfacing such as recycled SBR with polyurethane binder and EPDM with polyurethane binder, is used. In one embodiment, the primer may be a clear, polyurethane-based, one-component resin.

Advantageously, the play structure for the playground system of the present invention improves the safety, playability, and reduces maintenance requirements. The play structure is configured to develop core strength and coordination in toddlers. The play structures are a set of molded, rubber playground pieces that are shaped so that they can be used to develop balance and coordination in toddlers by walking, jumping, climbing on them.

In one or more embodiments of the play structures of the present invention, they are for use with toddlers or children diagnosed with "Low Muscle Tone". This typically occurs in early stages of development and can be caused by several factors—including genetics, disease, etc. Therapy for this diagnosis requires core training and strengthening. This strengthening impacts several areas of the child's development including gross motor skills (head, trunk, rotation, range of motion, reciprocal motion and posture); fine motor skills (grasping, dexterity, replacing objects, holding utensils and pointing), eating, language and speech. The present invention, when used with appropriate therapy exercises, is intended to improve the child's skills mentioned above.

In one or more embodiments, the play structures could be used by physical/occupational therapists to accomplish exercises intended to improve the patient's skills. The size, weight and shape of the play structure should provide enough space to accomplish these tasks without being cumbersome. As such, the present invention would also be portable such that a therapist or user could comfortably and easily carry the play structure for use at multiple locations. In one or more embodiments, this might also include the introduction of wheels, fixed, removable or retractable, as a means to move the play structure. A handle or strap could be incorporated, which could be recessed or attached to the bottom of the play structure, to facilitate movement. Further, the wheels could also, in certain cases, be incorporated into an exercise by allowing the patient to push or roll the play structure. Thus, therapy could be conducted in an easy, safe and efficient manner. The present invention would be comfortable without sacrificing the ability to be sturdy enough to complete exercises appropriately.

Further, the present invention could also be used by parents. Therapy techniques or exercises can be conducted daily, even in the absence of the therapist. The child's familiarity and possessive nature regarding the play structure creates a containable play area that is soft and safe. As the child gets older, he/she could still utilize the play structure as a play-station or seat for reading. The play structure strengthens the child's core muscles, regardless of beginning 'tone', while at play. This constantly helps build the foundation to reach the important milestones in the child's first years.

The present invention could also be used independently by patients in need of therapy and is not just limited to children. This play structure could also be used by patients that have suffered development set-backs as a result of disease or injury. An exercise regimen incorporating the play structure can be used to regain core and secondary muscle group strength which might have been lost. These could include grasping, pulling or balancing activities.

Coatings and Additives

The surfacing material of the outer layer and/or the inner molded unit may further be treated with one or more performance-enhancing additive such as one or more surfactants, antimicrobial agents, anti-freezing agents, or a combination thereof.

"Performance-enhancing active" or "Performance-enhancing additive" as used herein, refers to any additive which is desirable to add to the surfacing including an antimicrobial, an odor reducing material, a binder, a fragrance, a color altering agent, a dust reducing agent, a nonstick release agent, a superabsorbent material, cyclodextrin, zeolite, activated carbon, a pH altering agent, a salt forming material, a ricinoleate, silica gel, UV stabilizers or protectants, crystalline silica, activated alumina, an anti-clumping agent, and mixtures thereof. Performance-enhancing actives that inhibit the formation of odor include a water-soluble metal salt such as silver, copper, zinc, iron, and aluminum salts and mixtures thereof. In one embodiment, the performance-enhancing additive is sprayed onto the particles. In another embodiment, the performance-enhancing additives are dry-blended with the particles. In another embodiment the performance enhancing additive is blended with an elastomeric material then ground into particles.

In one embodiment, it is desirable to have a surface-modifying agent coating the rubber particles of synthetic PIP surfacing materials to provide a source of water for evaporative cooling of the turf surface during hot weather.

In another embodiment, the rubber particles are fabricated so that the surface-modifying agent coating comprises about 0.02% to about 10% by weight of core of granular material. In another embodiment, the surface-modifying agent coating comprises about 0.04% to about 5.0% by weight of the core of granular material. In another embodiment, the coating comprises about 0.06% to about 3.0% by weight of the core of granular material.

In one embodiment, performance-enhancing additive(s) are added to the material. In one embodiment, the performance-enhancing additive(s) are antimicrobials. In one embodiment, the antimicrobial actives are boron containing compounds such as borax pentahydrate, borax decahydrate, boric acid, polyborate, tetraboric acid, sodium metaborate, anhydrous, boron components of polymers, and mixtures thereof.

In one embodiment, the odor absorbing/inhibiting active inhibits the formation of odors. An illustrative material is a water-soluble metal salt such as silver, copper, zinc, iron, and aluminum salts and mixtures thereof. In another embodiment, the metallic salts are zinc chloride, zinc gluconate, zinc lactate, zinc maleate, zinc salicylate, zinc sulfate, zinc ricinoleate, copper chloride, copper gluconate, and mixtures thereof. In another embodiment, the odor control actives include nanoparticles that may be composed of many different materials such as carbon, metals, metal halides or oxides, or other materials. Additional types of odor absorbing/inhibiting actives include cyclodextrin, zeolites, silicas, activated carbon (also known as activated charcoal), acidic, salt-forming materials, and mixtures thereof. Activated alumina ($Al_2O_3$) has been found to provide odor control comparable and even superior to other odor control additives such as activated carbon, zeolites, and silica gel.

In some embodiments, additional additives may optionally be employed with the particulate compositions, including odor-binding substances, such as cyclodextrins, zeolites, inorganic or organic salts, and similar materials; anti-caking additives, flow modification agents, surfactants, viscosity modifiers, and the like. In addition, additives may be employed that perform several roles during modifications. For example, a single additive may be a surfactant, viscosity modifier, and may react to cross-link polymer chains.

In another embodiment, a color altering agent such as a dye, pigmented polymer, metallic paint, bleach, lightener, etc. may be added to vary the color of rubber particles, such as to darken or lighten the color of all or parts of the composition so it is more appealing. In another embodiment, the color-altering agent comprises up to approximately 20% of the infill composition, more preferably, 0.001%-5% of the composition. In another embodiment, the color altering agent comprises approximately 0.001%-0.1% of the composition.

In another embodiment, the carriers for the color-altering agent are zeolites, carbon, charcoal, etc. These substrates can be dyed, painted, coated with powdered colorant, etc.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the invention.

While the disclosure has been described with reference to exemplary embodiments, it will be understood by those skilled in the art that various changes may be made, and equivalents may be substituted for elements thereof without departing from the scope of the disclosure. In addition, many modifications may be made to adapt a particular system, device, or component thereof to the teachings of the disclosure without departing from the essential scope thereof. Therefore, it is intended that the disclosure is not limited to the particular embodiments disclosed for carrying out this disclosure, but that the disclosure will include all embodiments falling within the scope of the appended claims. Moreover, the use of the terms first, second, etc. do not denote any order or importance, but rather the terms first, second, etc. are used to distinguish one element from another.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description but is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable others of ordinary skill in the art to understand the disclosure for various embodiments with various modifications as are suited to the particular use contemplated.

The invention claimed is:

1. A play structure for a playground system, comprising:

an inner molded unit made of poured-in-place (PIP) rubber subsurface poured with a mixture of rubber buffing and at least one polymeric binder configured to deliver improved safety, playability, and reduced maintenance requirement, and a synthetic outer layer adhered to an outer surface of the inner molded unit, wherein the play structure is shaped to develop balance and coordination in toddlers;

at least one polymeric binder comprises between 5 wt. % to 30 wt. % of the poured-in-place (PIP) rubber subsurface mixture;

wherein the inner molded unit is a cushion unit;

wherein the outer layer is a harder wear layer; and wherein the play structure is configured to develop core strength.

2. The play structure of claim 1, wherein the at least one polymeric binder is selected from the group comprising polyurethane, polyester, polyether, polyacrylate, polystyrene, polyvinyl chloride, polyvinyl acetate, acrylic polyesters, polyethylene, polyepoxide, silicones, and combinations thereof.

3. The play structure of claim 1, wherein the rubber buffing is selected from the group consisting of Styrene Butadiene rubber (SBR) buffing, Ethylene Propylene Diene Monomer (EDPM) rubber, Nitrile Butadiene Rubber (NBR), natural rubbers, and combinations thereof.

4. The play structure of claim 1, wherein the play structure has a shock absorption rate of about 5-20%.

5. The play structure of claim 1, wherein the outer layer is made of Ethylene Propylene Diene Monomer (EDPM) rubber.

6. The play structure of claim 1, wherein the outer layer adheres to the outer surface of the inner molded unit using an adhesive layer.

7. The play structure of claim 6, wherein the adhesive layer is any one of a glue, a binder, or a resin.

8. The play structure of claim 1, wherein the play structure further comprises a flat bottom surface configured to mount over the playground system.

9. The play structure of claim 1, wherein the play structure further comprises an irregular top surface with different angles.

10. The play structure of claim 9, wherein the angles assist to bend the foot of the toddlers up and down to build muscles.

11. The play structure of claim 1, wherein the play structure is built into a synthetic rubber playground surface.

12. The play structure of claim 1, wherein the play structure further comprises a side edge angled between 60° and 30° with respect to an adjacent ground surface.

13. The play structure of claim 1, wherein the play structure is a gumdrop-shaped structure.

14. The play structure of claim 1, wherein the play structure is a rock-shaped structure.

15. A method for improving coordination of a user using the play structure for a playground system according to claim 1 and comprising the steps of:

a) providing two or more play structures for a playground system according to claim 1, wherein the play structure comprises a side edge angled between 60° and 30° with respect to an adjacent ground surface;

b) positioning the user at a selected first position on a surface of a first play structure; the user making a first contact with the side edge of the play structure;

c) wherein the user flexes at least one leg muscle according to the angle of the side edge;

d) moving the user from the first selected position to a second position; and the user making a further contact with the surface of the play structure.

* * * * *